US007155945B2

(12) United States Patent
Talpe, Jr.

(10) Patent No.: US 7,155,945 B2
(45) Date of Patent: Jan. 2, 2007

(54) LOCK HAVING A LOCKABLE HANDLE SHAFT

(76) Inventor: Joseph Talpe, Jr., Oudenaardsesteenweg 543, B-8581, Avelgem-Kerkhove (BE)

( * ) Notice: Subject to any disclaimer, the term of this patent is extended or adjusted under 35 U.S.C. 154(b) by 0 days.

(21) Appl. No.: 10/969,566

(22) Filed: Oct. 20, 2004

(65) Prior Publication Data

US 2005/0086981 A1 Apr. 28, 2005

(30) Foreign Application Priority Data

Oct. 24, 2003 (EP) ..... 03447267
Feb. 17, 2004 (EP) ..... 04447043

(51) Int. Cl.
*E05B 47/06* (2006.01)

(52) U.S. Cl. ..... 70/107; 70/210; 70/278.7; 70/283; 292/169.15; 292/169.17; 292/359

(58) Field of Classification Search ..... 70/107–111, 70/467, 470, 473, 474, 210, 279.1, 283, 283.1, 70/278.6, 277, 278.7, 278.1, 278.2, 278.3; 292/169.14, 169.15, 169.17, 144, 359, 150, 292/153

See application file for complete search history.

(56) References Cited

U.S. PATENT DOCUMENTS

| | | | | | |
|---|---|---|---|---|---|
| 2,486,268 | A | * | 10/1949 | Erkkila | 292/169.16 |
| 4,671,087 | A | * | 6/1987 | Olenfalk et al. | 70/283 |
| 4,802,353 | A | * | 2/1989 | Corder et al. | 70/277 |
| 4,854,143 | A | * | 8/1989 | Corder et al. | 70/218 |
| 5,000,018 | A | * | 3/1991 | Eisermann | 70/277 |
| 5,058,258 | A | * | 10/1991 | Harvey | 29/401.1 |
| 5,113,675 | A | * | 5/1992 | Uyeda | 70/477 |
| 5,484,179 | A | * | 1/1996 | Mader | 292/336.3 |
| 5,816,085 | A | * | 10/1998 | Winardi et al. | 70/283 |
| 5,884,515 | A | * | 3/1999 | Milman | 70/472 |
| 5,946,955 | A | * | 9/1999 | Suggs et al. | 70/218 |
| 6,145,353 | A | * | 11/2000 | Doucet | 70/277 |
| 6,490,896 | B1 | * | 12/2002 | Segawa | 70/208 |
| 6,845,642 | B1 | * | 1/2005 | Imedio Ocana | 70/277 |
| 6,895,791 | B1 | * | 5/2005 | Alexander et al. | 70/277 |
| 6,935,149 | B1 | * | 8/2005 | Peng et al. | 70/472 |
| 2001/0029760 | A1 | * | 10/2001 | Viney | 70/279.1 |

FOREIGN PATENT DOCUMENTS

| | | | |
|---|---|---|---|
| DE | 3643388 | | 6/1988 |
| DE | 195 14 742 | A1 | 10/1996 |
| EP | 1118739 | * | 7/2001 |
| GB | 2 260 568 | A | 4/1993 |

* cited by examiner

*Primary Examiner*—Lloyd A. Gall
(74) *Attorney, Agent, or Firm*—DLA Piper US LLP

(57) ABSTRACT

A lock including a frame, a handle operated latch bolt, a handle shaft, a latch bolt actuating mechanism and a mechanism for locking the handle shaft. The latch bolt locking mechanism includes a locking lever which is fixed with respect to the handle shaft and arranged to cooperate with a stop element on the frame. The latch bolt locking mechanism further includes an electromagnet which moves the locking lever with respect to the handle shaft or the stop element with respect to the frame so that the locking lever can be unlocked and locked behind the stop element. The locking device, which is either formed by the locking lever or by the stop element, is movable by the electromagnet in a direction forming an angle greater than about 45°, preferably greater than about 65°, with a flat plane extending at right angles to the longitudinal axis of the handle shaft. A more reliable locking and unlocking of the handle shaft can be produced.

26 Claims, 10 Drawing Sheets

LOCK HAVING A LOCKABLE HANDLE SHAFT

RELATED APPLICATION

This application claims priority of European Patent Application Nos. EP 03447267.0, filed Oct. 24, 2003, and EP 04447043.3, filed Feb. 17, 2004.

FIELD OF THE INVENTION

This invention relates to a lock. More particularly, this invention relates to a lock with an energizable electromagnet.

The present invention relates to a lock comprising a frame; a bolt movably mounted on the frame between a locking and an unlocking position and arranged to be operated by means of at least one handle; a shaft for said handle, which shaft has a longitudinal axis and is pivotally mounted about its longitudinal axis on the frame between a first and a second angular position; a mechanism for actuating the bolt upon rotation of the handle shaft to move the bolt from its locking to its unlocking position when the handle shaft is rotated from its first angular position to its second angular position and to move the bolt from its unlocking to its locking position when the handle shaft is rotated from its second angular position to its first angular position; and a mechanism for locking the handle shaft, which locking mechanism is arranged to be brought in two states, namely in a locking state wherein the handle shaft is locked in its first angular position and in an unlocking state wherein the handle shaft is unlocked, said locking mechanism comprising a locking means which is movable, in the first angular position of the handle shaft, between a first position wherein it locks the handle shaft in its first angular position and a second position wherein the handle shaft is unlocked; and actuating means, comprising an electromagnet, for moving said locking means between its first and second positions, the electromagnet being arranged to move the locking means by magnetic attraction of at least a portion of the locking means.

BACKGROUND

A lock of the type described above is disclosed in DE-A-36 43 388. The mechanism for locking the handle shaft comprises a locking lever on the handle shaft and a stop element pivotally mounted about a pivot on the frame between a first position wherein it blocks the locking lever and a second position wherein it enables rotation of the locking lever and, hence, of the handle shaft. The stop element is moved by magnetic attraction thereof, by an electromagnet. Since the pivot of the stop element extends substantially parallel to the handle shaft, the stop element is moved by the electromagnet in a direction which is situated substantially in a plane extending at right angles to the handle shaft.

A drawback of such an arrangement is that the locking mechanism of the handle shaft is difficult to be made very reliable, especially if the lock is used outdoors. For a skilled person, it will indeed be clear that under varying weather conditions and,, as a result of dust or other dirt penetrating into the lock, the required rotation of the stop element in the lock illustrated in DE-A-36 43 388 can be hampered so that the locking mechanism can no longer be operated. Dust or other dirt can penetrate in particular between the stop element and the surface of the frame onto which it slides.

The rotation of the stop element can especially also be obstructed in case of frosty weather, when dew or condensation becomes frozen in the lock.

It would therefore be advantageous to provide a new lock wherein the mechanism for locking the handle shaft can be kept simple but rendered more robust or reliable.

DETAILED DESCRIPTION

It will be appreciated that the following description is intended to refer to specific embodiments of the invention selected for illustration in the drawings and is not intended to define or limit the invention, other than in the appended claims.

This invention relates to a lock comprising a frame; a bolt movably mounted on the frame between a locked and an unlocked position and arranged to be operated by at least one handle; a shaft for the handle, which shaft has a longitudinal axis and is pivotally mounted about its longitudinal axis on the frame between a first and a second angular position; a mechanism for actuating the bolt upon rotation of the handle shaft to move the bolt from a locked to an unlocked position when the handle shaft is rotated from a first angular position to a second angular position and to move the bolt from the unlocked to the locked position when the handle shaft is rotated from the second angular position to the first angular position; and a mechanism for locking the handle shaft, which locking mechanism is arranged to be brought in two states, namely a locked state wherein the handle shaft is locked in a first angular position and in an unlocked state wherein the handle shaft is unlocked, the locking mechanism comprising a locking means which is movable, in the first angular position of the handle shaft, between a first position wherein it locks the handle shaft in the first angular position and a second position wherein the handle shaft is unlocked: and actuating means, comprising an electromagnet, for moving the locking means between the first and second positions, the electromagnet being arranged to move the locking means by magnetic attraction of at least a portion of the locking means.

An advantage of such a lock is that the handle operated bolt can be used to prevent an unauthorized opening of the door or gate, even when a handle is provided on both sides of the door or gate or when the lock is applied to a gate through or over which the handle on the other side of the gate can be reached. Since the handle shaft locking mechanism comprises an electromagnet; control by an electronic access control device can be provided and/or by a remote control. When the lock is applied, for example, onto a garden gate, such a remote control may enable to lock and unlock the gate for example from within the house. When the gate is unlocked, for example, when one is outside the house, the gate can still be opened and closed by means of the handles.

In addition to the handle operated bolt, in particular a latch bolt, the lock can also comprise a dead bolt operated by a key and/or by an electronic access control device. The presence of the handle shaft locking mechanism offers the advantage that the door or gate cannot only be locked by the dead bolt, but also by the handle operated bolt. Consequently, when one is in the house, the garden gate can be locked, for example, only by the handle operated bolt so that the lock can be unlocked by a remote control while, when one has left the house, the garden gate can be locked both by the dead bolt and optionally by the handle operated bolt to provide additional security. To unlock the handle operated bolt, an electronic access control device is preferably provided and/or the lock preferably comprises a mechanism to unlock the handle operated bolt when unlocking the dead bolt by a key operated lock cylinder.

The lock according to this invention is characterized in that the portion of the locking means, which is arranged to be attracted by an electromagnet, is movable in a direction forming an angle greater than about 45°, preferably greater than about 65°, with a flat plane extending at right angles to the longitudinal axis of the handle shaft.

An advantage of the lock according to the invention is that, due to the different direction wherein the locking means has to be moved, a larger electromagnet, which acts on a larger portion of the locking means, can be provided in the lock thus increasing the reliability and robustness of the lock as a result of the fact that greater magnetic forces can be generated to move the locking means. A simple, robust and reliable construction of the handle shaft locking mechanism can thus be achieved. The arrangement of the locking means enables moreover a locking means of a considerable size without requiring a sliding motion between the locking means and the frame so that reliability can be increased.

In an advantageous embodiment of the lock according to aspects of the invention, the portion of the locking means which is arranged to be attracted magnetically has a smaller course when locking and unlocking the handle shaft than a further portion of the locking means which provides for the locking of the handle shaft.

Such a smaller course is possible due to the fact that stronger electromagnets can be used in the locks according to the invention and enables the use of electromagnets having a fixed core. An advantage of an electromagnet with a fixed core (which is prone to oxidation) can be rendered more easily water resistant. Moreover, compared to an electromagnet with a movable core, which is required in case of larger gaps between the electromagnet and the part to be attracted, an electromagnet with a fixed core is more reliable. A movable core can indeed get stuck so that the lock does not function but also so that the coil of the electromagnet can be damaged when being energized over a long period of time.

In a further advantageous embodiment of the lock according to aspects of the invention, the electromagnet is arranged to hold the locking mechanism in its locked state when the electromagnet is being energized. In this way, a further protection against possible freezing of the lock is provided since freezing of the lock is prevented by the-heat generated by the electromagnet.

BRIEF DESCRIPTION OF THE DRAWINGS

Other particularities and advantages of the invention will become apparent from the following description of some particular embodiments of the lock according to the invention. This description is however only given by way of example and is not intended to limit the scope of to the annexed drawings wherein.

Figure 1:
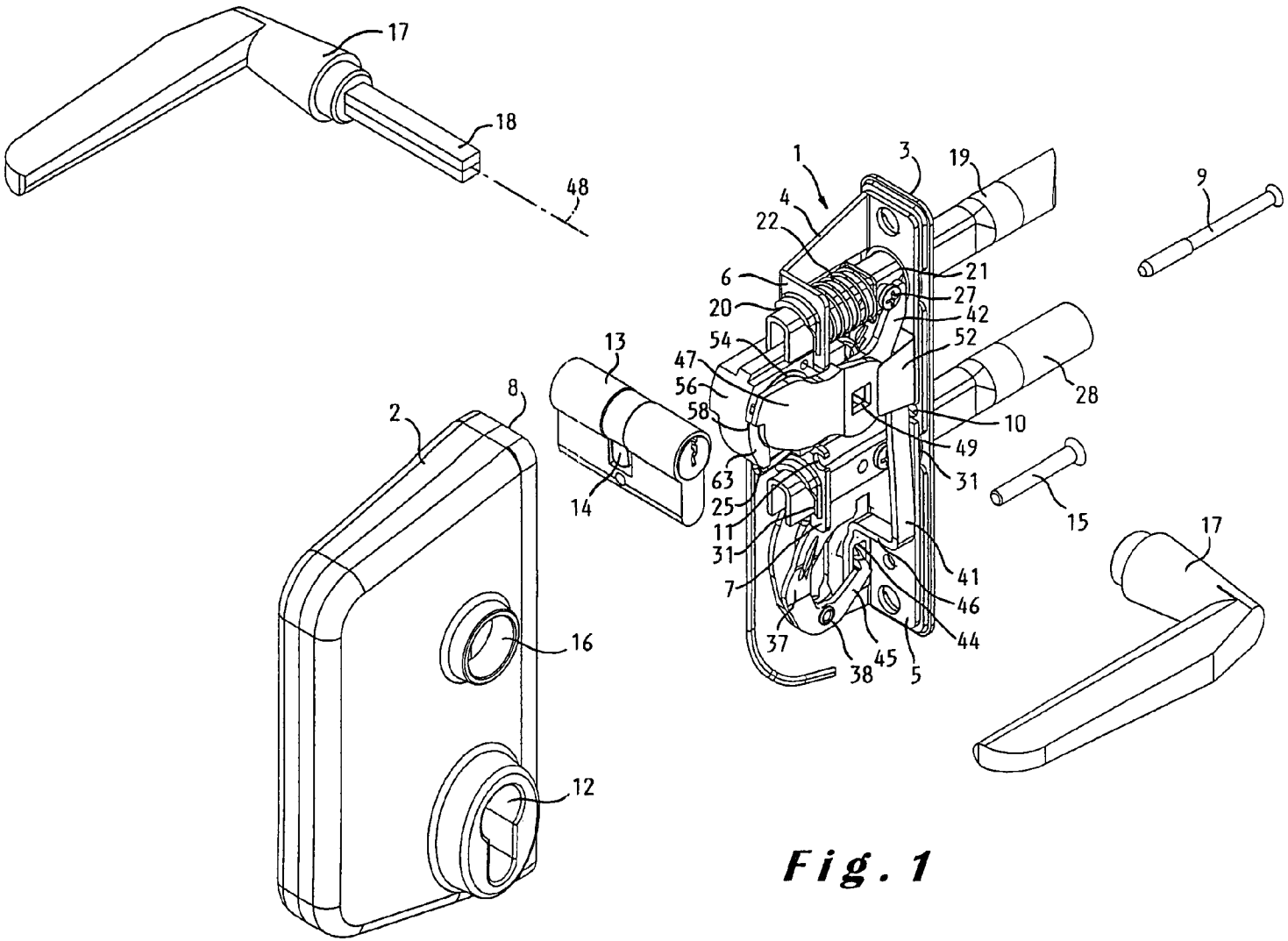
FIGS. 1 and 2 are partially exploded views respectively from the front and the back of a lock according to a first embodiment of the invention.

The lock shown in the drawings is a lock provided to be mounted against a profile, in particular a tubular profile, of a gate, fence, door the like. The profile is provided with holes so that both the latch and the dead bolt can project therethrough. When mention is made of a retracted position of the latch or dead bolt, this consequently does not mean that the bolt is retracted within the lock but that it is retracted within the tubular profile or that it extends over a small distance out of this profile. In its extended position, the bolt then extends over a larger distance out of the tubular profile, the difference between these two distances being called the stroke of the bolt. When the lock is mounted so that the latch and dead bolts do not have to extend through a profile, the length thereof can of course be reduced.

Figure 2:
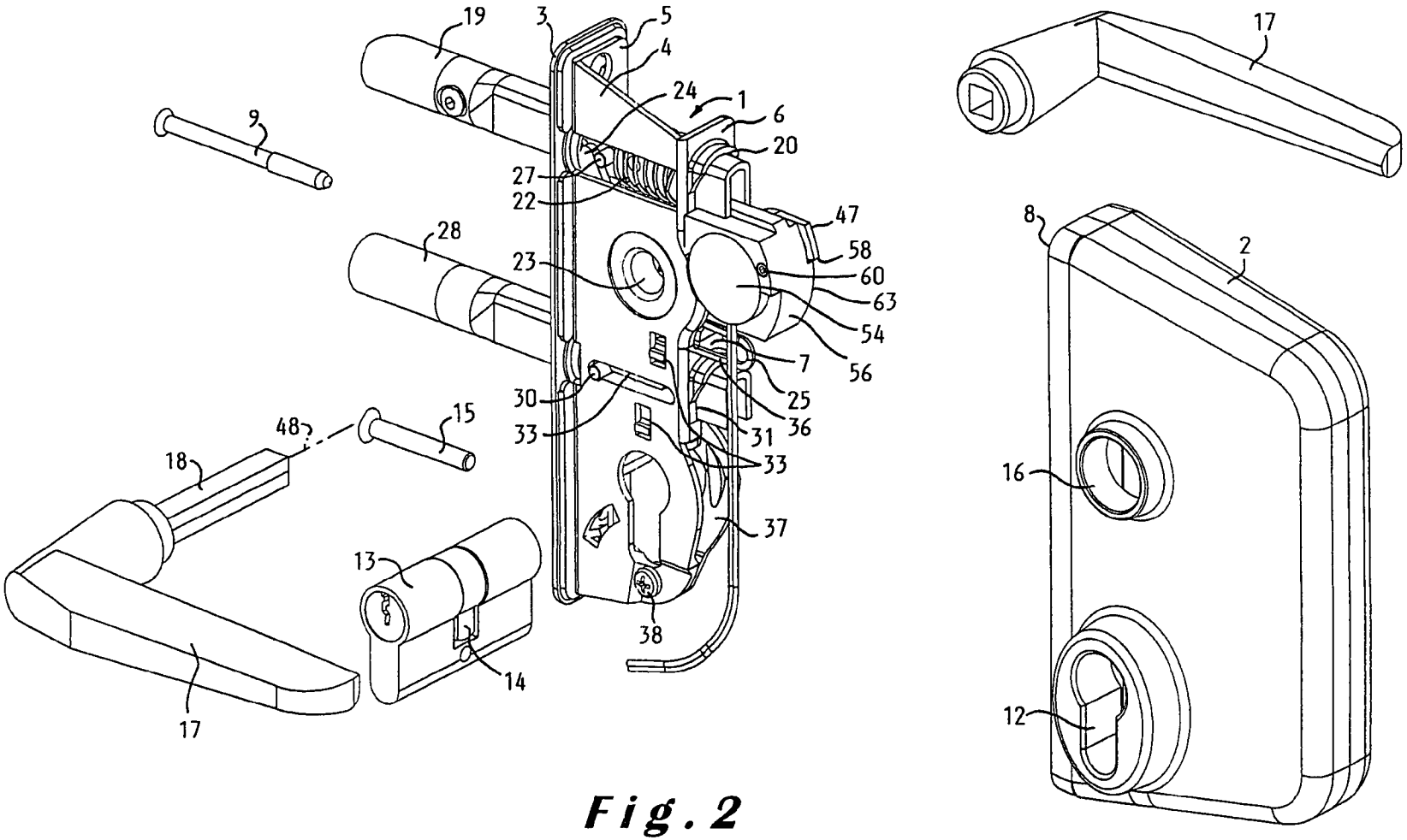
Figure 3:
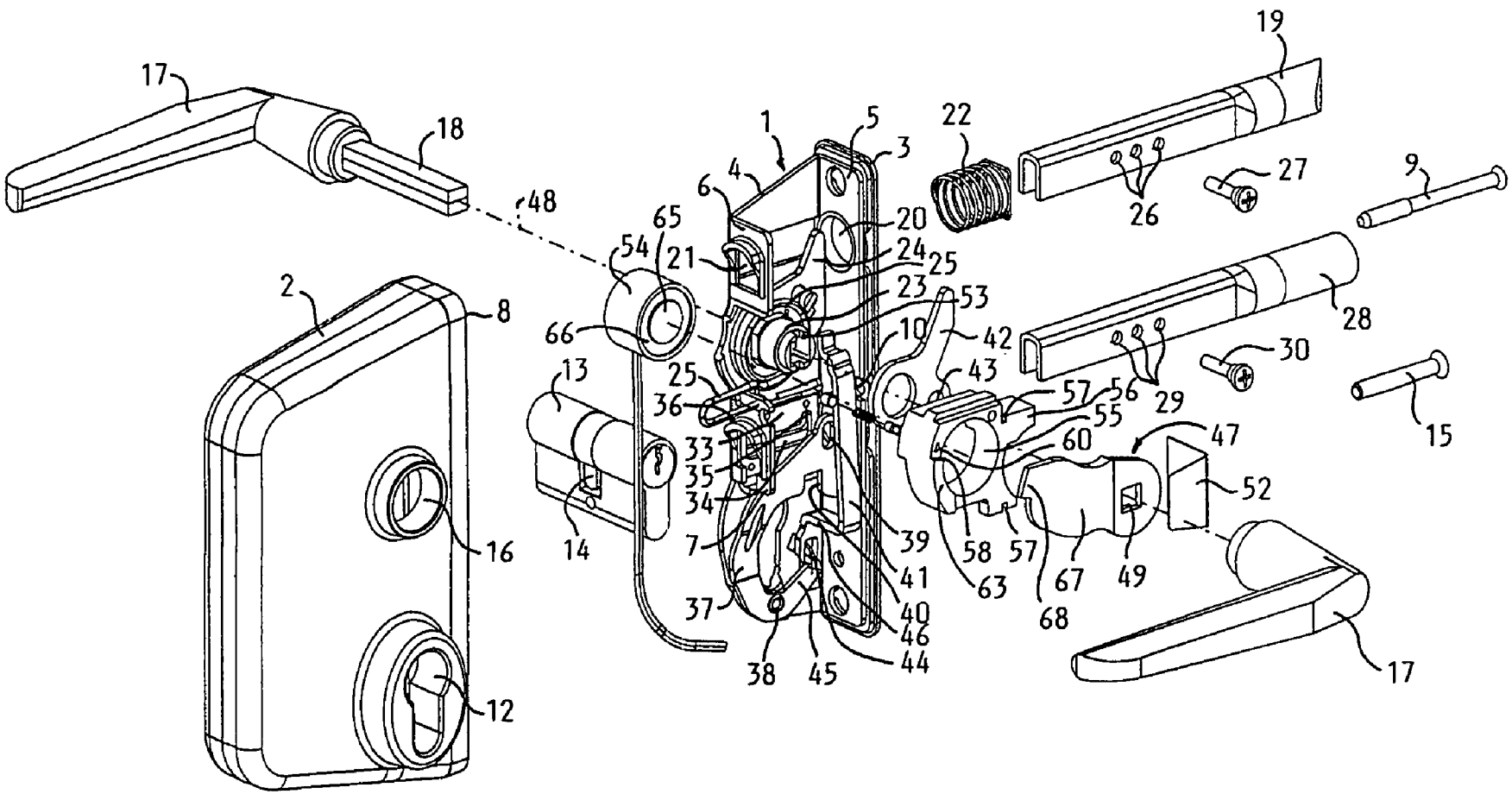
FIG. 3 is an exploded view of the lock of FIGS. 1 and 2, but illustrated more elements in a disassembled state.
Figure 4:
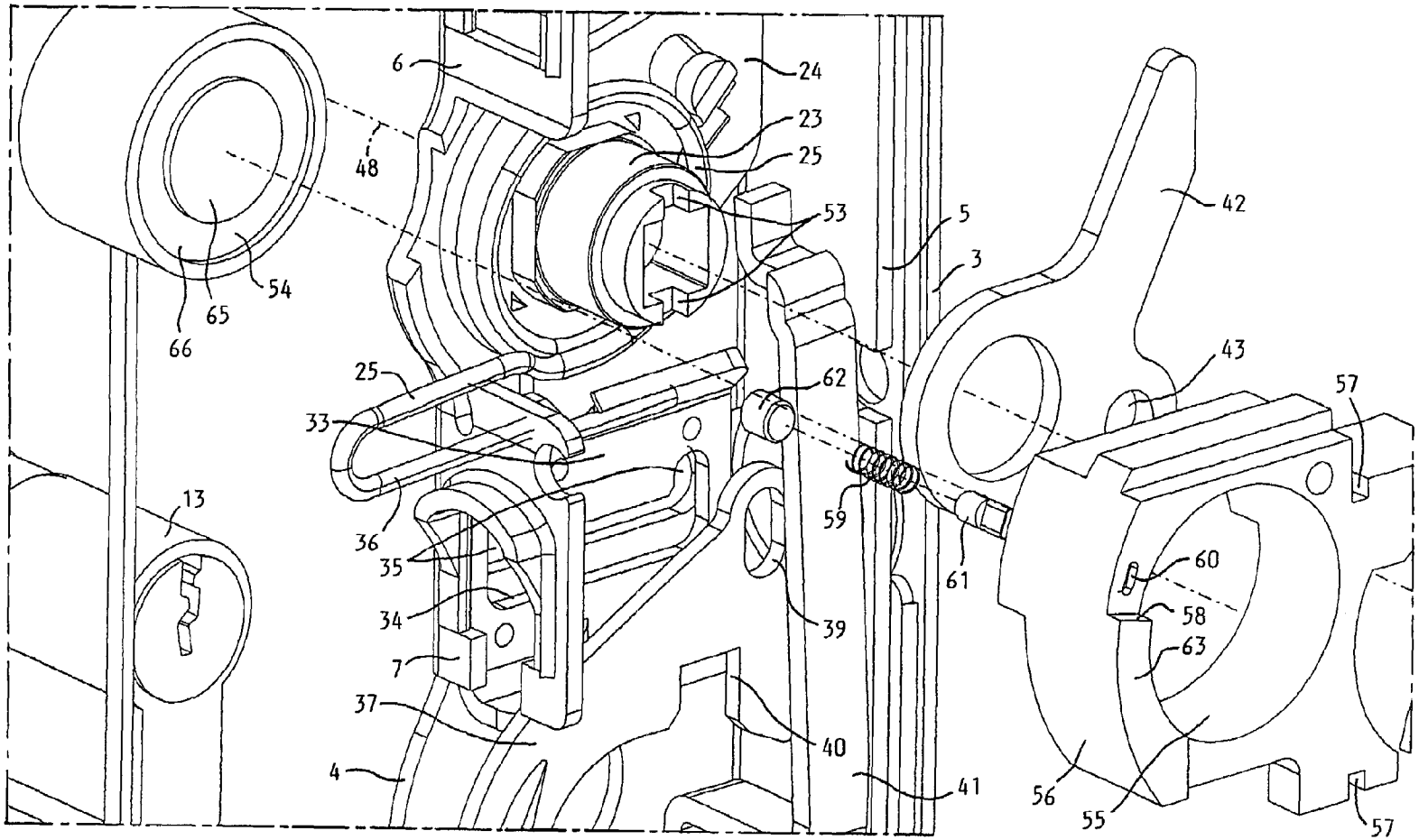
FIG. 4 illustrates on a larger scale a portion of FIG. 3.
Figure 5:
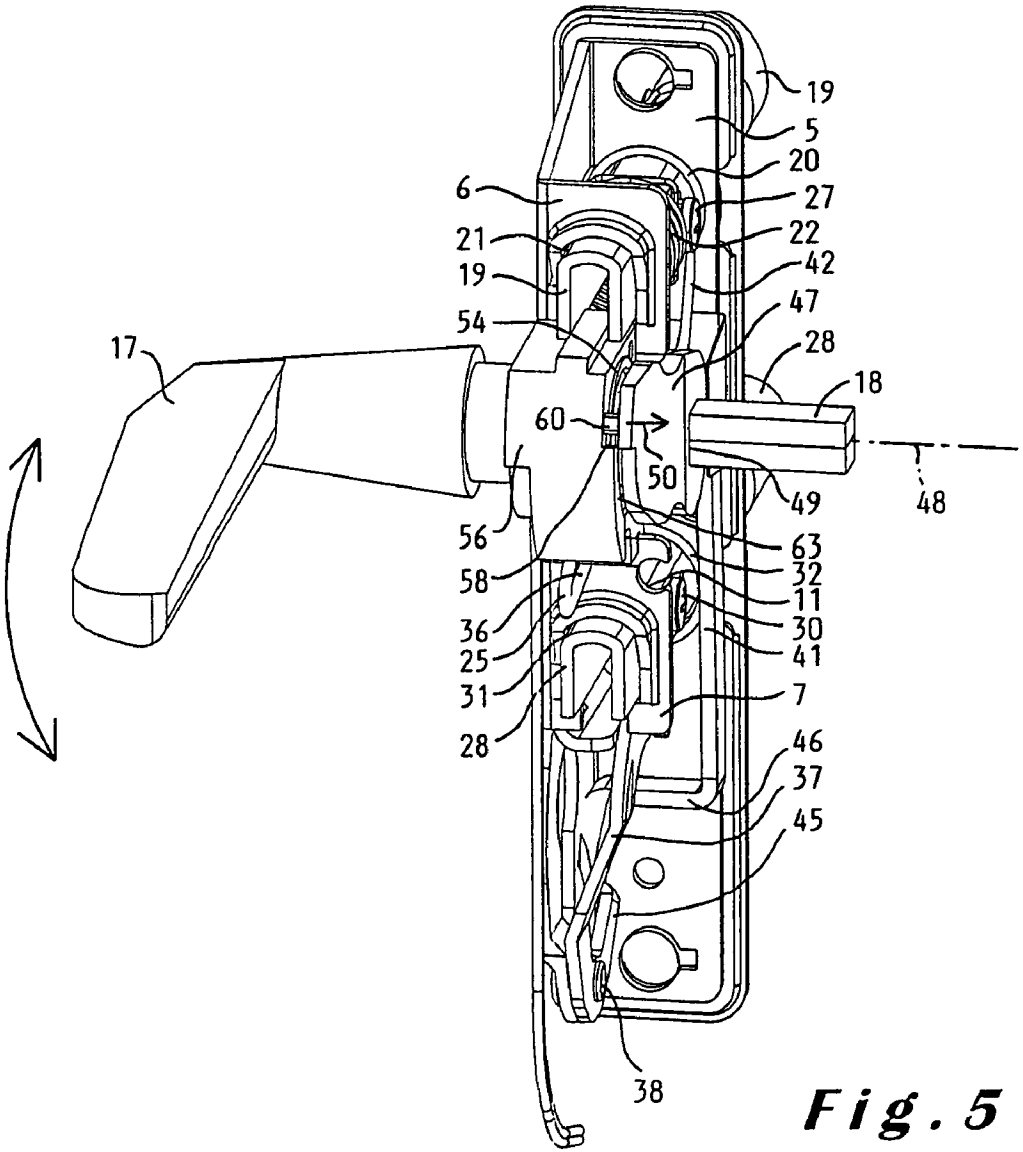
FIG. 5 is a perspective view on a lateral side of the lock illustrated in the previous figures, but having one handle and the cover box removed.
Figure 6:
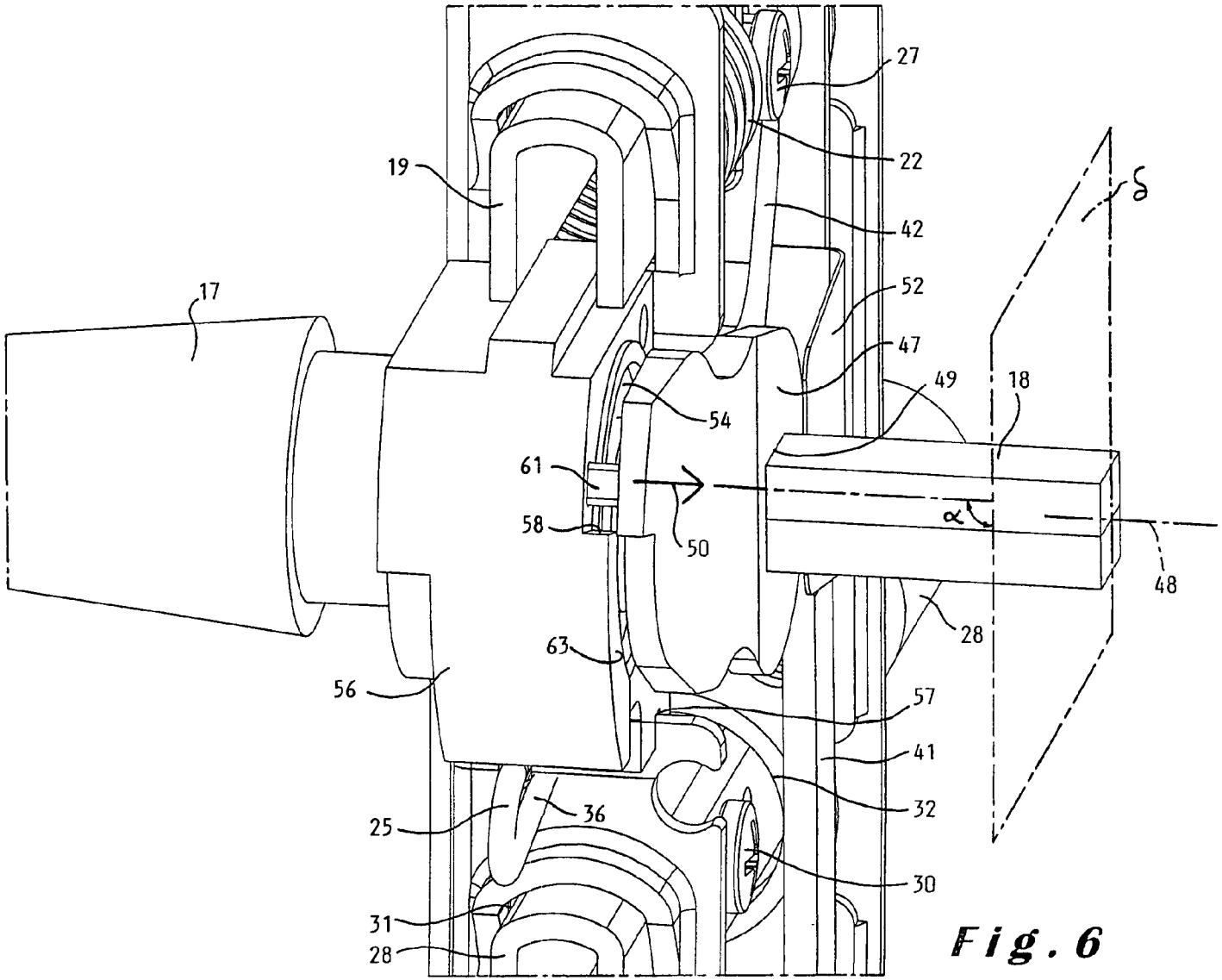
FIG. 6 illustrates on a larger scale a portion of FIG. 5 wherein the handle shaft is unlocked by the locking mechanism.
Figure 7:
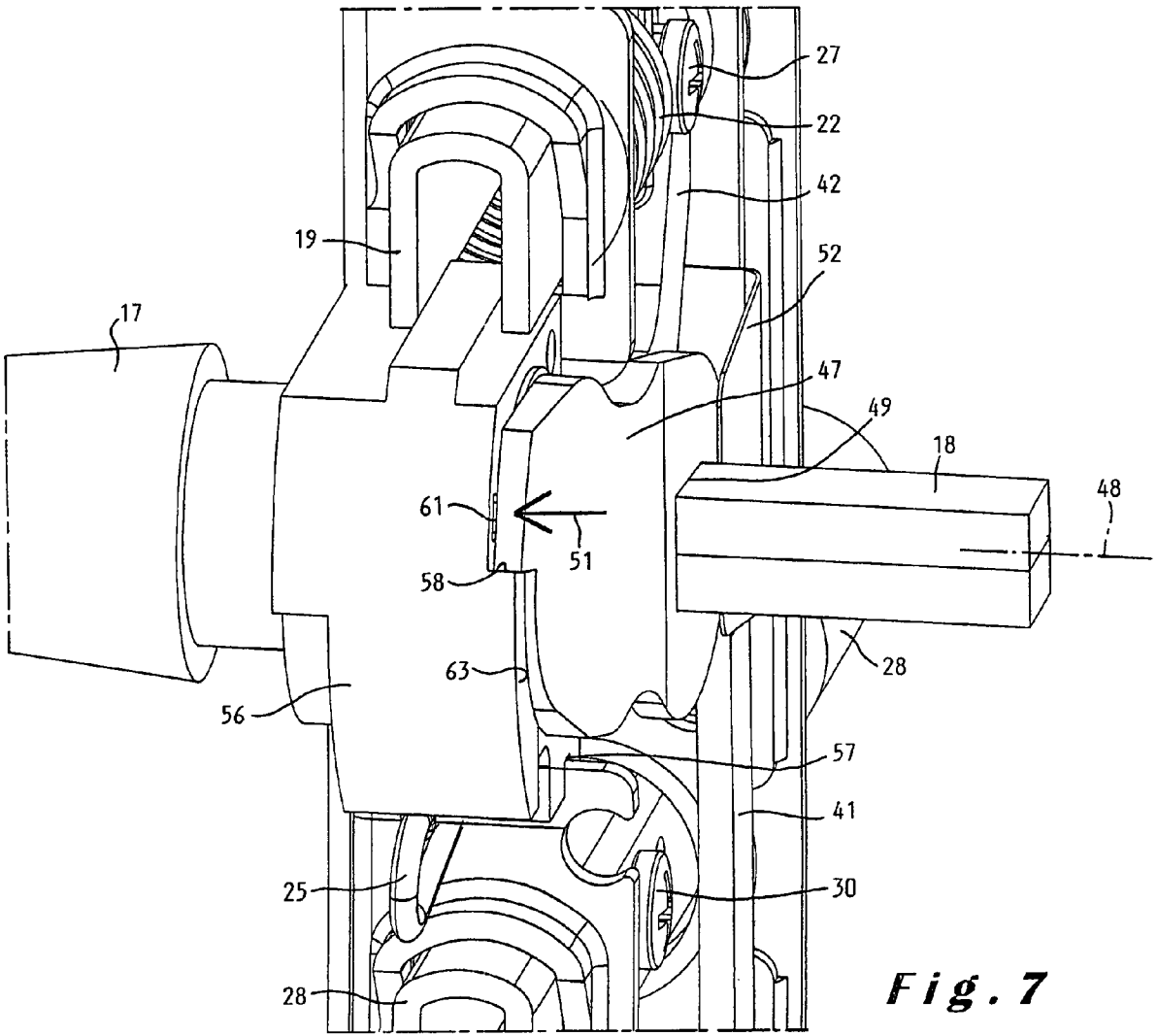
FIG. 7 is a same view as FIG. 6, but illustrates the handle shaft in its locked state.

The lock illustrated in FIGS. 1 to 7 comprises a frame 1 composed of a cover box 2, a front cover plate 3 for closing the box 2 and a base plate 4 arranged within the closed box 2. The base plate 4 has on its front side an upstanding edge 5 and on its back side two upstanding edge portions 6, 7. The cover box 2 has such dimensions that the base plate 4 can be slid completely therein, more particularly through the substantially rectangular front opening 8 of the box 2, even the upstanding edge 5.

The cover plate 3, which is fixed to the upstanding edge 5 of the base plate 4, is somewhat larger than the front opening 8 so that it engages against the peripheral edge thereof. By means of a screw 9, which passes through an opening 10 in the upstanding edge 5 and an opening 11 in the upstanding edge portion 7 of the base plate 4, the base plate and cover plate are fixed to the cover box.

The cover box 2 is provided with two aligned openings 12 through which a cylinder 13 can be inserted in the lock, in particular a so-called "Euro-cylinder" corresponding to the standard DIN V18254/07.91. This key actuated cylinder 13 comprises a rotary driving bit 14 which rotates around a central axis of the cylinder to actuate the lock as described hereinafter. The cylinder 13 is fixed in the lock by a screw 15 passing through little holes made in the cover plate 3 and in the upstanding edge 5 of the base plate 4. The cover box 2 is further provided with two additional aligned openings 16 through which the door handles 17 can be mounted to the lock. Both handles 17 are mounted onto a square handle shaft 18, having a longitudinal axis 48 and extending uninterruptedly from one handle to the other. In this way, both handles move simultaneously and the lock can be operated by both handles without having to actuate first any clutch mechanism.

The lock further comprises a bolt 19 which is operated by the handles 17 to move it between a locking and an unlocking position. The bolt 19 is in particular a latch bolt which is slidably mounted on the frame 1 of the lock, more particularly within an opening 20 in the upstanding edge portion 6 and an opening 21 in the upstanding edge 5 of the base plate 4. The latch bolt 19 can thus move between a projecting position shown in FIGS. 1 and 2 and a retracted position which has not been shown. A compression spring 22 is applied over the latch bolt 19 to urge the bolt to its projecting position. For bringing the latch bolt 19 by means of the handles 17 to its retracted position to open the gate, the rectangular handle shaft 18 is inserted in a corresponding hole in a follower 23. This follower 23 is provided in its turn with a latch bolt lever 24 which follows the rotations of the handles 17 and which engages the latch bolt 19 against the action of a main spring 25 to retract this latch bolt. The main spring 25 serves to push the latch bolt lever 24 and thus the follower 23 and the handles 17 and handle shaft 18 to their initial rest positions. The handle shaft 18 can be rotated by the handles 17 between a first angular position, wherein the latch bolt 19 is in its projecting or locking position, and a second angular position, wherein the latch bolt 19 is in its retracted or unlocking position.

Threaded holes 26 are provided in the lateral sides of the latch bolt 19 to allow an adjustment of the latch bolt. In any one of these holes 26 an adjustment screw 27, forming an abutment for the compression spring 22 and for the latch bolt lever 24 can be fixed. The different positions of the holes 26 correspond to different distances over which the latch bolt 19 projects out of the lock.

In addition to the latch bolt, the lock also comprises a dead bolt 28. The dead bolt 28 is slidably mounted on the frame 1 between a projecting position, illustrated in FIGS. 1 and 2, and a retracted position which has not been illustrated. The dead bolt 28 can more particularly slide in an opening 31 in the upstanding edge portion 7 and an opening 32 in the upstanding edge 5 of the frame 1. Just like the latch bolt, the dead bolt 28 is provided with threaded holes 29 wherein a screw 30 can be fixed. The holes 29 are located to enable an adjustment of the distance over which the dead bolt projects out of the lock, i.e. to enable to adjust the lock to different diameters of the profile to which it is to be mounted.

In contrast to the latch bolt, the dead bolt 28 is not urged by a spring to its projecting positions but is locked in both its retracted and projecting positions by locking means. In the illustrated embodiment, these locking means comprise a retaining plate 33 which is slidably mounted in the up- and downward direction on the frame 1. The plate 33 is provided with a slot 34, which form at both ends an upward notch 35. In its normal position, the plate 33 is urged downwardly by an end 36 of the main spring 25, which engages an upstanding edge of the plate 33, SO that the screw 30 fixed to the dead bolt projects into one of the notches 35 and thus locks the dead bolt 28 in one of its extreme positions.

The movement of the dead bolt 28 between its two extreme positions is controlled by rotating the key in the cylinder 13, or in other words by the resulting rotation of the rotary driving bit 14. When rotating this bit 14, it first of all engages the bottom edge of the retaining plate 33 so that this plate is lifted and the dead bolt is unlocked. In the embodiment illustrated in the figures, the rotary driving bit 14 does not act directly upon the dead bolt 28, but instead through the intermediary of a dead bolt lever 37. This lever 37 is pivoted onto the base plate 4 about a pivot 38. The free extremity of the lever 37, situated opposite the pivot 38, is provided with a slot 39. This free extremity extends within the dead bolt 28 so that the adjustment screw 30 extends through the slot 39 of the lever 37.

The driving bit 14 engages the dead bolt lever 37 in a notch 40 situated between the dead bolt 28 and the pivot 38 to actuate the dead bolt. When rotating the key and thus the driving bit of the cylinder 13, the dead bolt lever 37 rotates in the same direction around the pivot 38 and the dead bolt moves along since the screw 30 extends through the slot 39 in the dead bolt lever 37. It is also possible to omit the intermediate dead bolt lever 37 and to have the driving bit of the cylinder act directly upon the dead bolt, more particularly, into notches provided in the lower side of the dead bolt. The presence of the dead bolt lever offers, however, the advantage of increasing the stroke of the dead bolt.

An additional advantage of the presence of the dead bolt lever 37 is that it can be used to move a second turn pusher 41 into and out of the path of the rotary driving bit 14. Such a second turn pusher 41 is connected to a second turn lever 42 arranged to move the latch bolt 19, against the action of the compression spring 22, from its projecting to its retracted position. The second turn lever 42 is more particularly rotatably applied over the follower 23. It engages the screw 27 on the latch bolt 19 and shows further a hole 43 wherein the free extremity of the pusher 41, which is hook shaped, is applied. At its other free extremity, the pusher 41 is provided with a slot 44 by means of which it is slidably connected to an arm 45 of the dead bolt lever 37. This connection between the pusher 41 and the arm 45 of the dead bolt lever 37 is located between the dead bolt 28 and the pivot 38 of the dead bolt lever 37 so that the pusher 41 is out of the path of the rotary driving bit 14 in the projecting position of the dead bolt 28, but comes into this path when the dead bolt moves, upon a first turn of the rotary bit 14, to its retracted position. Upon a second turn of the rotary bit 14, this rotary bit 14 engages a hook shaped portion 46 of the pusher 41 and pushes this pusher 41 upwards to rotate the second turn lever 42 and thus retract the latch bolt 19.

EP-B-1 118 739 discloses further details of the above described features of the lock, the subject matter of which is incorporated herein by reference.

In addition to the above described elements, the lock further comprises a mechanism for locking the handle shaft 18 so that the lock cannot only be locked by the dead bolt, but also by the latch bolt. Although the presence of a dead bolt is preferred, it is also possible to omit the dead bolt, and the above described mechanism for operating the dead bolt by means of the cylinder 13.

The mechanism for locking the handle shaft 18 comprises a locking means which is movable, in the first angular position of the handle shaft 18, between a first position wherein it locks the handle shaft in its first angular position and a second position wherein the handle shaft 18 is unlocked. In the embodiment illustrated in FIGS. 1 to 7, this locking means is formed by a locking lever 47. The locking lever 47 is fixed to the handle shaft 18 so that it rotates together with the handle shaft about the longitudinal axis 48 thereof. The locking lever 47 is provided with an opening 49 through which the handle shaft 18 extends. The handle shaft 18 engages the inner side of the opening 49 of the locking lever 47. The opening 49 in the locking lever 47 has a shape that prevents the locking lever from rotating around the longitudinal axis 48 of the handle shaft with respect to this handle shaft 18. The opening 49 has substantially the same square cross-section as the handle shaft. The opening 49 in the locking lever 47 fits with some clearance around the handle shaft 18 so that the locking lever 47 can rotate over a small angle in a plane comprising the longitudinal axis 48 of the handle shaft 18 as shown by the arrows 50 and 51 in FIGS. 5, 6 and 7.

The locking lever 47 engages the front of the follower 23 and the front of the second turn lever 42 which is applied over the follower 23. When the cover box 2 and the handles 17 and the handle shaft 18 are removed from the lock, the locking lever 47 is maintained in its position against the follower 23 and the second turn lever 42 by a resilient, hook shaped piece of sheet metal 52 which is fixed to the upstanding edge S of the base plate 4. To maintain the locking lever 47 in the right angular position with respect to the follower 23 so that the handle shaft 18 can be easily inserted in the lock, the front side of the follower 23 is provided with two notches 53 (see FIG. 4) wherein corresponding projections on the back of the locking lever 47 can engage (not shown).

In addition to the locking lever 47, the mechanism for locking the handle shaft 18 comprises actuating means, including an electromagnet 54 which is fixed in a hole 55 in a mounting element 56 and which comprises at least one coil 66 and a core 65, in particular, a soft iron core. This mounting element 56 is fixed to the base plate 4 of the lock. The mounting element 56 is more particularly positioned with one end between the two upstanding edge portions 6 and 7 of the base plate 4 and has two grooves 57 wherein the upstanding edge portions 6 and 7 extend to fix the mounting element to the base plate.

The electromagnet 54 is arranged to lock the locking lever 47 and, hence, the handle shaft 18, in its first angular position, namely in the angular position of the handle shaft wherein the latch bolt 19 is in its locking or projecting position. The electromagnet 54 and the locking lever 47 are mounted in such a manner in the lock that, in the first angular position of the handle shaft 18, the locking lever 47 is situated in front of the electromagnet 54 so that a portion 67 of the locking lever, which is preferably a plate-like element, can be attracted magnetically towards the electromagnet. In an alternative embodiment, the electromagnet 54 can be mounted on the locking lever 47 so that it moves together with the locking lever. The portion of the locking lever which is attracted in this embodiment magnetically is the electromagnet itself. In fact, the locking lever 47 is moved in this embodiment by magnetic attraction between the electromagnet 54 and a portion of the frame or an element which is fixed to the frame.

According to the invention, the portion 67 of the locking means, in this embodiment the portion of locking lever 47, which is arranged to be attracted by the electromagnet 54, is movable in a direction 50, 51 forming an angle $\alpha$ greater than about 45°, preferably greater than about 65°, and most preferably greater than about 80° with a flat plane $\delta$ extending at right angles to the longitudinal axis 48 of the handle shaft 18. In the embodiment illustrated in FIGS. 1 to 7, the portion 67 of the locking lever 47 which is attracted by the electromagnet 54 is moved in a direction 50, 51 which is substantially parallel to the longitudinal axis 48 of the handle shaft 18 so that the locking lever can be rotated, as explained above and as illustrated in FIGS. 5 to 7, in a plane containing the longitudinal axis 48 of the handle shaft 18. In this embodiment, the locking lever 47 is attracted by the electromagnet 54 in the same direction as the direction wherein the locking lever is moved, so that the direction wherein the electromagnet attracts the locking lever forms also an angle $\alpha$ with a flat plane $\delta$ extending at right angles to the longitudinal axis 48 of the handle shaft 18 which is greater than about 45°, preferably greater than about 65°, and most preferably greater than about 80°. The direction wherein the electromagnet 54 attracts the locking lever 47 is also substantially parallel to the longitudinal axis 48 of the handle shaft 18.

The front surface of the mounting element 56 for the electromagnet 54 has a shoulder forming a stop element 58 which is fixed with respect to the frame and which is in a fixed position with respect to the frame. The stop element 58 engages a locking portion 68 of the locking lever for locking the locking lever 47 in the locked state of the locking mechanism, when the locking lever 47 is attracted magnetically towards the electromagnet in the first angular position of the handle shaft. When the portion 68 of the locking lever 47 is blocked behind the stop element 58, the handle shaft 18 can no longer be rotated from its first to its second angular position so that the latch bolt can no longer be operated by the handles 17 and is thus locked.

In order to unlock the locking lever 47, the actuating means of the locking mechanism of the lock illustrated in the drawings comprise, in addition to the electromagnet 54, a spring 59 for urging the locking lever 47 away from the electromagnet 54 so that the portion 68 of the locking lever 47 can pass the stop element 58 when the locking mechanism is in its unlocked state (see FIGS. 5 and 6), when the electromagnet 54 is de-energized so that the locking lever is no longer attracted by the electromagnet. In this state, the handle shaft 18 can thus be rotated from its first to its second angular position to withdraw the latch bolt 19.

The spring 59 may be a leaf spring positioned between the locking lever 47 and the front surface of the mounting element 56. In the preferred embodiment illustrated in FIG. 4 the spring 59 is, however, a spiral compression spring 59 applied in a boring 60 in the mounting element 56 underneath the locking lever 47. The boring extends substantially in the same direction as the direction wherein the locking lever is moved when the electromagnet is energized and de-energized in the first angular position of the handle shaft. At the location of the stop element 58, this direction is substantially parallel to the longitudinal axis 48 of the handle shaft 18. The end of the boring 60 facing the locking lever 47 has a reduced cross-section and is slot shaped while the other part of the boring is cylindrical. In order to enable the spring 59 to urge the locking lever 47 away from the electromagnet 54, a sliding piece 61 is provided in the boring 60, the sliding piece 61 having one end with a reduced cross-section projecting through the slot shaped end of the boring and another, cylindrical end fitting into the cylindrical part of the boring 60. The boring 60 is closed off by a stopper 62 to maintain the spring 59 and the sliding piece 61 in the boring 60. The end of the sliding piece which has a reduced cross-section so that it can penetrate through the slot shaped end of the boring has such a length that, when being pushed out of the boring by the spring, i.e. when the electromagnet is de-energized, it can push the locking lever 47 away from the electromagnet so that it can be rotated by the handle shaft over the stop element or shoulder 58 (see FIGS. 5 and 6).

As explained above, the portion 68 of the locking lever can be locked behind the stop element or shoulder 58 when energizing the electromagnet. In the lock illustrated in FIGS. 1 to 7, the locking lever is locked behind the stop 58, even when the electromagnet is energized when the handle shaft is rotated by one of the handles so that it is not in its first angular position wherein the latch bolt projects out of the lock. The locking mechanism of the illustrated lock comprises a guide 63 formed by the mounting element 56 on the other side of the shoulder or stop element 58 so that, even when the locking lever 47 is attracted towards the electromagnet 54, the springs 22 and 25 are strong enough to rotate the handle shaft back to its first angular position with the locking lever 47 sliding over the guide surface 63 until it snaps behind the stop element and pushes the sliding piece 61 into the boring 60. When actuating the locking means to lock the latch bolt, the latch bolt will be locked, independent of the angular position of the handle shaft 18.

In the above described preferred embodiment, the electromagnet is arranged to hold the locking mechanism in its locking state when the electromagnet is being energized. An advantage of this embodiment is that, due to the heat generated by the electromagnet, the lock is prevented from being frozen in case of cold weather. Another advantage is that in the case of a power failure (for example, as a result of a fire), the door or gate is unlocked automatically.

An advantageous feature of the lock illustrated in FIGS. 1 to 7 is that the portion 67 of the locking lever 47 which is arranged to be attracted magnetically has a shorter course when locking and unlocking the handle shaft than the portion 68 which provides for the locking of the handle shaft 18. The electromagnet 54 is more particularly arranged between the handle shaft 18 and the stop element 58. In this way, there is only a small gap between the electromagnet and the locking lever so that the electromagnet may comprise a fixed core, instead of a movable core to move the locking lever by direct magnetic attraction.

Figure 8:
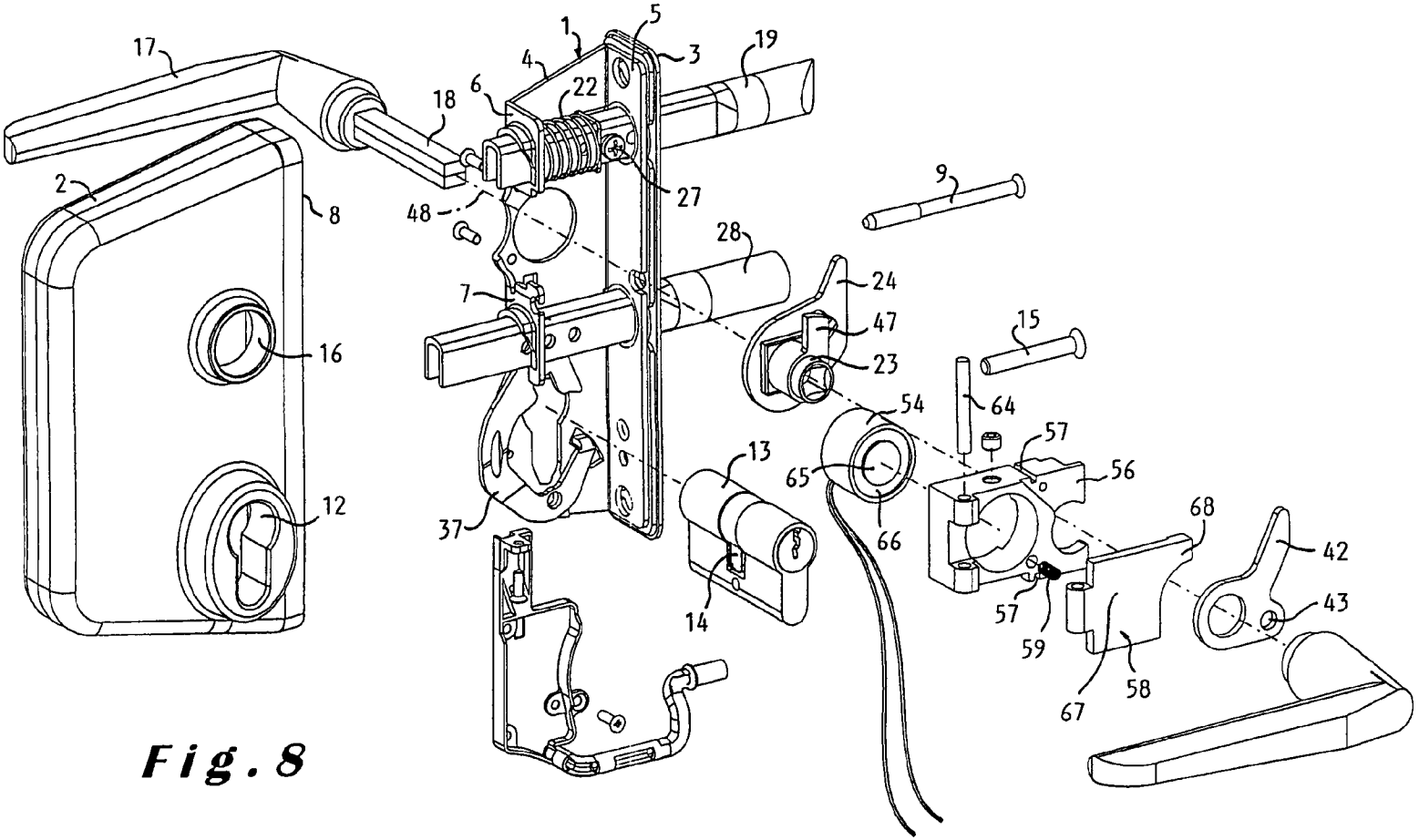
FIG. 8 is an exploded view of the main parts of a lock according to a second embodiment of the invention.
Figure 9:
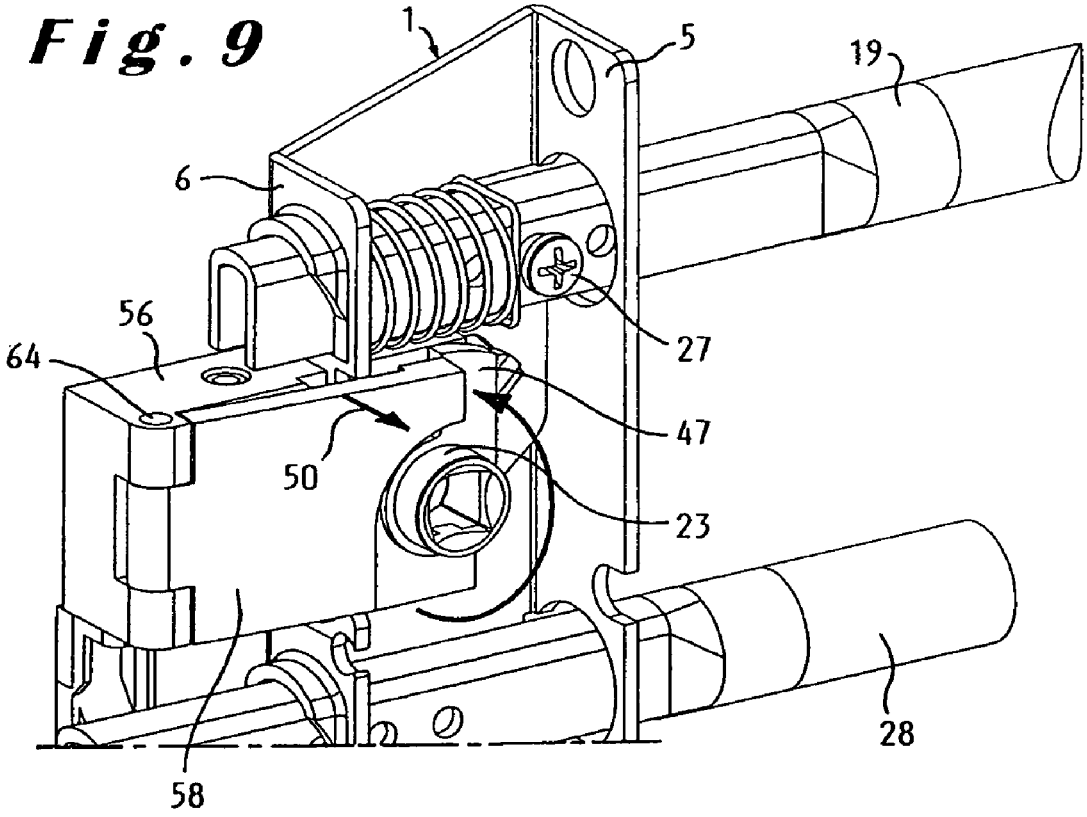
FIGS. 9 and 10 are perspective views of a portion of a partially assembled lock according to FIG. 8, illustrating the locking mechanism of the handle shaft respectively in its unlocked and locked states.
Figure 10:
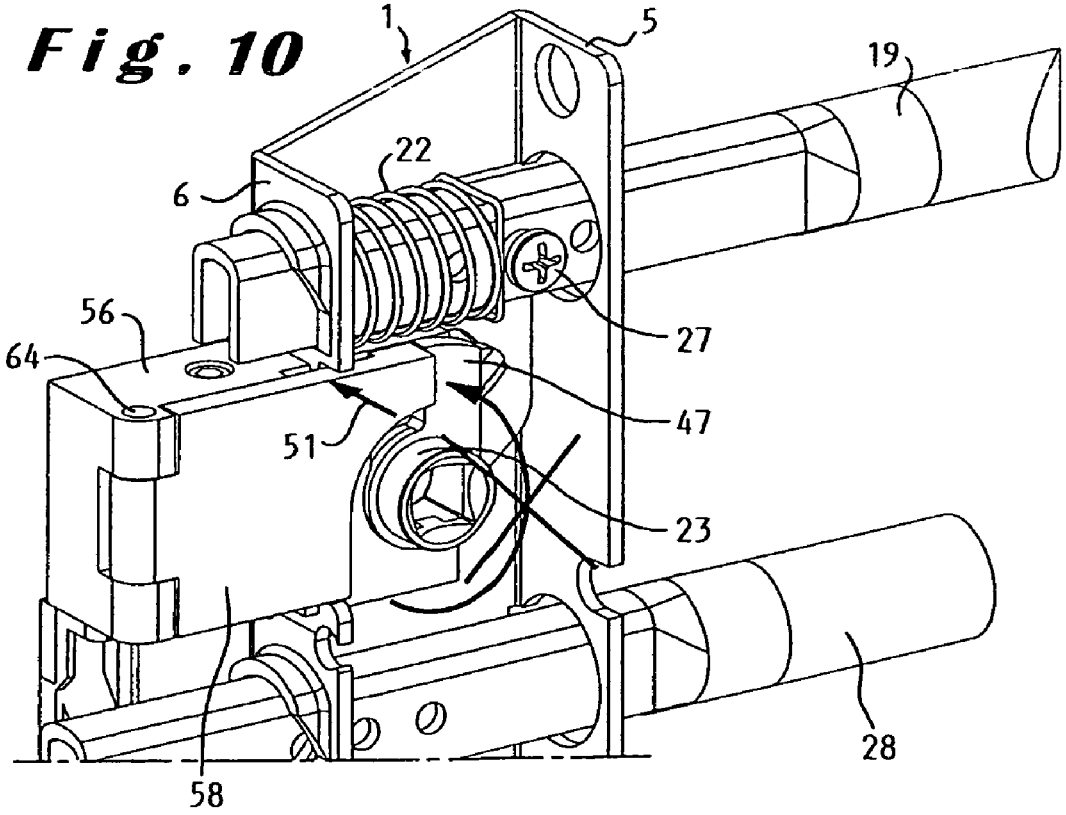
Figure 11:
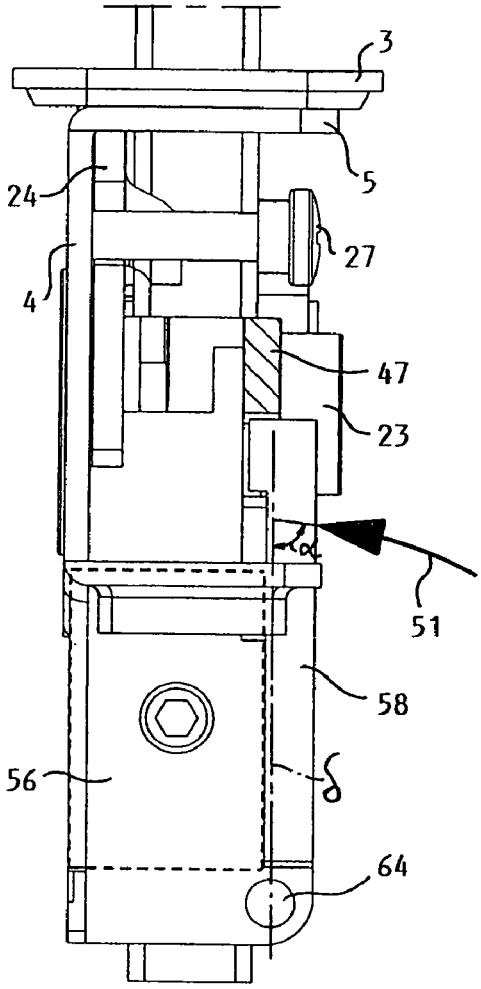
FIGS. 11 and 12 are top plan views of a partially assembled lock according to FIGS. 8 to 10 and illustrating the locking mechanism of the handle shaft respectively in its locked and unlocked state.
Figure 12:
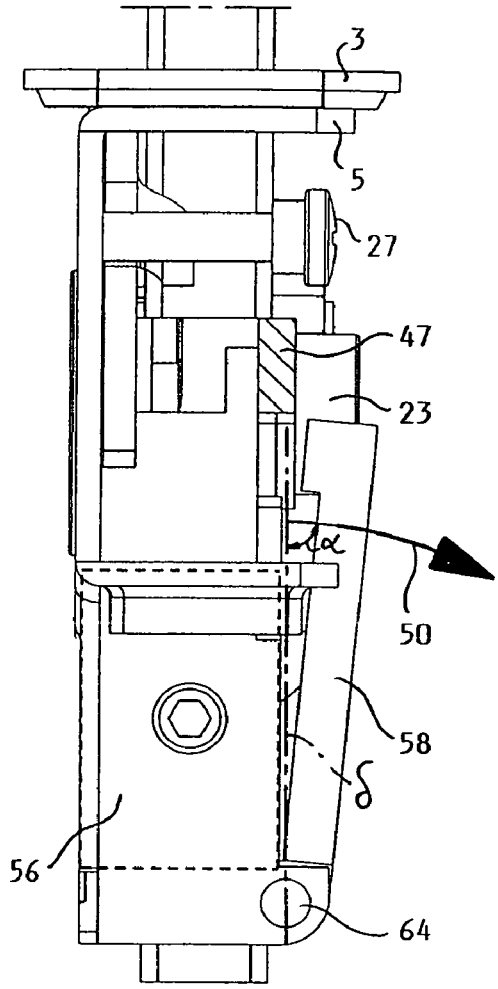

FIGS. 8 to 12 illustrate a further preferred embodiment of a lock according to the invention. The main parts of this lock are equal to or at least similar to the corresponding parts of the lock illustrated in FIGS. 1 to 7 so that they will not be described here again. The most important difference between both embodiments is the construction of the mechanism for locking the handle shaft 18.

In the embodiment according to FIGS. 8 to 12 this locking mechanism also comprises an electromagnet 54, a mounting element 56 for mounting the electromagnet onto the frame 1 of the lock, a locking lever 47 and a stop element 58 cooperating with the locking lever for locking the handle shaft 18 in its first angular position. In contrast to the previous embodiment, the locking lever 47 is now fixed to the handle shaft so that it cannot be moved with respect to the handle shaft while the stop element 58 is movable by the electromagnet 54 to enable to lock and unlock the handle shaft. In this embodiment, the movable locking means is thus formed by the stop element 58 instead of by the locking lever 47.

The stop element 58 is formed by a plate-like element which is pivotally mounted on the frame by means of a pivot 64 onto the mounting element 56 of the electromagnet 54. A helical compression spring 59 is positioned between the stop element 58 and the mounting element 56 and is partially located in a recess in the mounting element 56 and arranged to urge the stop element 58 away from the electromagnet 54. A portion 67 of the stop element 58 extends in front of the electromagnet 54 so that it can be attracted thereby against the pressure exerted by the spring 59. The stop element 58 can thus pivot away from the electromagnet 54 as indicated by arrow 50 in FIG. 9 or towards the electromagnet as indicated by arrow 51 in FIG. 10.

In one of the two extreme positions of the stop element 58, the locking lever 47 is locked behind a portion 68 of the stop element 58, having a protrusion, while in the other extreme position of the stop element 58 the locking lever 47 can pass the stop element 58 so that the handle shaft is unlocked. The handle shaft is preferably locked by the stop element when the electromagnet is energized.

The pivot axis 64 of the stop element 58 forms an angle smaller than about 45°, preferably smaller than about 25° and more preferably smaller than about 10° with the flat plane δ which extends at right angles to the longitudinal axis 48 of the handle shaft 18. The pivot axis 64 of the stop element 58 extends substantially at right angles to the longitudinal axis 48 of the handle shaft 18. Due to the orientation of the pivot 64, the portion of the locking means, in this case the stop element, which is attracted by the electromagnet 54, is again movable in a direction 50, 51 forming an angle α(see FIGS. 11 and 12) greater than about 45°, preferably greater than about 65° and more preferably greater than about 80° with a flat plane δ extending at right angles to the longitudinal axis 48 of the handle shaft 18. The direction wherein the portion 67 of the stop element 58 which is attracted by the electromagnet 54 moves is again substantially parallel to the longitudinal axis 48 of the handle shaft 18. As set forth above, by such an arrangement of the locking means, in this case the stop element, a more reliable lock can be achieved due to the fact that a larger electromagnet and a larger area of magnetic attraction between the electromagnet and the locking means can be provided in the lock.

An advantageous feature of the lock illustrated in FIGS. 8 to 12 is again that the portion 68 of the stop element 58, which is arranged to be attracted magnetically, has a smaller course when locking and unlocking the handle shaft than the portion 67 which provides for the locking of the handle shaft 18. The electromagnet 54 is more particularly situated between the locking lever 47 and the pivot axis 64 of the stop element 58 50 that when the electromagnet is de-energized, and the stop element has moved away from the electromagnet, the gap between the electromagnet and the stop element can be kept to a minimum, thus maximizing the magnetic attraction when energizing the electromagnet again, while the course of the portion 68 of the stop element 58 which engages the locking lever 47 is large enough to be brought into and out of engagement with the locking lever 47. An important advantage of a small gap between the electromagnet and the stop element is that the metal (iron) core of the electromagnet may be a fixed core. Such an electromagnet with a fixed core can be rendered more easily water resistant, which is important since the iron core is prone to oxidation. Moreover, even an oxidized core will not hamper the functioning of the lock since it does not have to slide within the electromagnet. Apart from the core of the electromagnet, and the element attracted thereby, the lock is preferably made of materials which do not oxidize. The lock is more preferably made of stainless steel and optionally of some synthetic parts.

With respect to the location of the electromagnet 54, it is preferred to mount the electromagnet onto the frame of the lock but, as mentioned above with regard to the first embodiment, it is also possible to incorporate the electromagnet 54 in the stop element. Also in this case, the electromagnet moves the stop element 58 by magnetic attraction between the frame or a fixed element and the electromagnet of the stop element. The portion of the stop element which is magnetically attracted is the electromagnet itself, in particular, the metal core thereof.

It will be clear that many modifications can be applied to the above described embodiments without departing from the spirit of the invention as defined in the appended claims.

The locking means may, for example, comprise two or more separate elements. This is, for example, an advantageous solution when the functioning of the handle shaft locking mechanism is to be reversed so that the electromagnet is arranged to hold the locking means in its unlocked state when the electromagnet is being energized. In this case, a plate like element can be provided on the opposite side of the electromagnet and connected by a small rod, extending through a hole made in the core of the electromagnet, with the movable stop element 58 or the movable locking lever 47 from the above described embodiments so that when the plate like element is magnetically attracted by the electromagnet on one side of the magnet, the movable element 47 or 58 of the locking means on the other side of the electromagnet is pushed away from the electromagnet thus resulting in a reversed operation. The rod may be formed of a separate third part or may be fixed to either one of other elements of the locking means on both sides of the electromagnet.

What is claimed is:

1. A lock comprising:

a frame;

a bolt movably mounted on the frame between a locked and an unlocked position and arranged to be operated by at least one handle;

a shaft for the handle, which shaft has a longitudinal axis and is pivotally mounted about the longitudinal axis on the frame between a first and a second angular position;

a mechanism for actuating the bolt upon rotation of the handle shaft to move the bolt from the locked to the unlocked position when the handle shaft is rotated from the first angular position to the second angular position and to move the bolt from the unlocked to the locked position when the handle shaft is rotated from the second angular position to the first angular position; and a mechanism for locking the handle shaft, which locking mechanism is arranged to be brought in a locked state wherein the handle shaft is locked in the first angular position and in an unlocked state wherein the handle shaft is unlocked, the locking mechanism comprising:

a locking lever which is mounted on the handle shaft to rotate together with the handle shaft about the longitudinal axis thereof;

a stop element which is mounted on the frame and arranged to cooperate with the locking lever to lock the handle shaft in the first angular position; the locking lever or the stop element forming a locking device which is movable, in the first angular position of the handle shaft, between a first position that locks the handle shaft in the first angular position and a second position wherein the handle shaft is unlocked; and an actuator comprising an electromagnet that moves the locking device between the first and second positions, the electromagnet being arranged to move the locking device by magnetic attraction of at least a portion of the locking device, which portion of the locking device is movable in a direction forming an angle ($\alpha$) greater than about 45° with a flat plane ($\delta$) extending at right angles to the longitudinal axis of the handle shaft.

2. The lock as claimed in claim 1, wherein said angle ($\alpha$) is greater than about 65 °.

3. The lock as claimed in claim 1, wherein said angle ($\alpha$) is greater than about 80°.

4. The lock as claimed in claim 3, wherein said direction of movement of the portion of the locking device is substantially parallel to the longitudinal axis of the handle shaft.

5. The lock as claimed in claim 1, wherein the electromagnet is disposed such that the portion of the locking device is magnetically attracted in a direction forming an angle greater than about 45° with the flat plane ($\delta$) extending at right angles to the longitudinal axis of the handle shaft.

6. The lock as claimed in claim 1, wherein the locking device comprises a plate-shaped element which is arranged for being attracted by the electromagnet.

7. The lock as claimed in claim 1, wherein the electromagnet is arranged to hold the locking device in its locked state when the electromagnet is energized.

8. The lock as claimed in claim 1, wherein the actuator of the locking mechanism comprises at least one spring that urges the locking device away from the electromagnet.

9. The lock as claimed in claim 1, wherein the handle shaft extends through the lock and is arranged to mount two handles to the lock, a first handle on one side of the lock and a second handle on the other side of the lock, the handle shaft extending uninterruptedly from the first handle to the second handle.

10. The lock as claimed in claim 1, wherein the bolt is a latch bolt and the bolt actuation mechanism comprises a spring that urges the latch bolt towards the locked position.

11. The lock as claimed in claim 10, further comprising a dead bolt operated by a key operated lock cylinder having a rotary driving bit that moves the dead bolt between a projecting and a retracted position, a second turn lever pivotally mounted on a shaft on the frame that moves the latch bolt from a locked to an unlocked position upon rotation of the second turn lever, and a second turn pusher actuated by the rotary driving bit and connected to the second turn lever to rotate the second turn lever upon actuation by the driving bit to move the latch bolt to an unlocked position and a mechanism that moves the second turn pusher in the path of the rotary driving bit when the dead bolt is moved from the projecting to the retracted position.

12. The lock as claimed in claim 1, wherein the locking device is formed by the locking lever, which locking lever moves by the electromagnet with respect to the handle shaft so that, in the locked state of the locking mechanism, the locking lever is locked behind the stop element while, in the unlocked state of the locking mechanism, the locking lever is shifted with respect to the stop element so that the locking lever can pass the stop element when the handle shaft moves between the first and second angular positions.

13. The lock as claimed in claim 12, wherein the locking lever has an opening through which the handle shaft extends, the handle shaft engaging an inner side of the opening in the locking lever.

14. The lock as claimed in claim 13, wherein the opening in the locking lever enables rotational movement of the locking lever in a plane comprising the longitudinal axis of the handle shaft and the locking lever moves as a whole according to the rotational movement when locking and unlocking the handle shaft by the actuator.

15. The lock as claimed in claim 14, wherein the electromagnet is arranged between the handle shaft and the stop element.

16. The lock as claimed in claim 1, wherein the locking device is formed by the stop element which is movable by the actuator with respect to the frame so that, in the locked state of the locking mechanism, the locking lever is locked behind the stop element while, in the unlocked state of the locking mechanism, the stop element is moved with respect to the locking lever so that the locking lever can pass the stop element when the handle shaft moves between the first and second angular positions.

17. The lock as claimed in claim 16, wherein the stop element is pivotally mounted on the frame about a pivot axis forming another angle smaller than about 45° with the flat plane ($\delta$) which extends at right angles to the longitudinal axis of the handle shaft.

18. The lock as claimed in claim 17, wherein the electromagnet is arranged between the locking lever and the pivot axis.

19. The lock as claimed in claim 1, wherein the portion of the locking device arranged to be attracted magnetically has a shorter path of movement when locking and unlocking the handle shaft than a further portion of the locking device that locks the handle shaft.

20. The lock as claimed in claim 1, wherein the electromagnet comprises a coil and a fixed core which is substantially not movable in the coil.

21. A lock comprising:

a frame;

a bolt movably mounted on the frame between a locked and an unlocked position and arranged to be operated by at least one handle;

a shaft for the handle, which shaft has a longitudinal axis and is pivotally mounted about the longitudinal axis on the frame between a first and a second angular position;

a mechanism for actuating the bolt upon rotation of the handle shaft to move the bolt from the locked to the unlocked position when the handle shaft is rotated from the first angular position to the second angular position and to move the bolt from the unlocked to the locked position when the handle shaft is rotated from the second angular position to the first angular position; and a mechanism for locking the handle shaft, which locking mechanism is arranged to be brought in a locked state wherein the handle shaft is locked in the first angular position and in an unlocked state wherein the handle shaft is unlocked, the locking mechanism comprising:

a locking lever mounted on the handle shaft so that the locking lever rotates together with the handle shaft about the axis; and an electromagnet and a stop fixed with respect to the frame for locking the locking lever with the handle shaft in its first angular position and for unlocking the locking lever, at least a portion of the locking lever moves by the electromagnet with respect to the handle shaft so that, in the locked state of the locking mechanism, the locking lever is locked behind the stop while, in the unlocked state of the locking mechanism, the portion of the locking lever is shifted with respect to the stop so that the locking lever can pass the stop when the handle shaft moves between the first and second angular positions.

22. The lock as claimed in claim 21, wherein the locking device further comprises a guide arranged to guide the portion of the locking lever over the stop into the locking state behind the stop when the locking device is actuated to lock the locking lever when the handle shaft is not in the first angular position, but is rotated subsequently into the first angular position.

23. A lock comprising:

a frame;

a bolt movably mounted on the frame between a locked and an unlocked position and arranged to be operated by at least one handle;

a shaft for the handle, which shaft has a longitudinal axis and is pivotally mounted about the longitudinal axis on the frame between a first and a second angular position, the handle shaft extending through the lock and being arranged to mount two handles to the lock, a first handle on the side of the lock and a second handle on the other side of the lock, the handle shaft extending uninterruptedly from the first handle to the second handle;

a mechanism for actuating the bolt upon rotation of the handle shaft to move the bolt from the locked to the unlocked position when the handle shaft is rotated from the first angular position to the second angular position and to move the bolt form the unlocked to the locked position when the handle shaft is rotated from the second angular position to the first angular position; and a mechanism for locking the handle shaft, which locking mechanism is arranged to be brought in a locked state wherein the handle shaft is locked in the first angular position and in an unlocked state wherein the handle shaft is unlocked, the locking mechanism comprising:

a locking device which is movable, in the first angular position of the handle shaft, between a first position that locks the handle shaft in the first angular position and a second position wherein the handle shaft is unlocked; and an actuator comprising an electromagnet that moves the locking device between the first and second positions, the electromagnet being arranged to move the locking device by magnetic attraction of at least a portion of the locking device, which portion of the locking device is movable in a direction forming an angle ($\alpha$) greater than about 45° with a flat plane ($\delta$) extending at right angles to the longitudinal axis of the handle shaft.

24. A lock comprising:

a frame;

a latch bolt movably mounted on the frame between a locked and an unlocked position and arranged to be operated by at least one handle;

a shaft for the handle, which shaft has a longitudinal axis and is pivotally mounted about the longitudinal axis on the frame between a first and a second angular position;

a mechanism for actuating the latch bolt upon rotation of the handle shaft to move the latch bolt from the locked to the unlocked position when the handle shaft is rotated from the first angular position to the second angular position and to move the latch bolt from the unlocked to the locked position when the handle shaft is rotated from the second angular position to the first angular position, the latch bolt actuation mechanism comprising a spring that urges the latch bolt towards the locked position;

a dead bolt operated by a key operated lock cylinder having a rotary driving bit that moves the dead bolt between a projecting and a retracted position;

a second turn lever pivotally mounted on a shaft on the frame that moves the latch bolt from a locked to an unlocked position upon rotation of the second turn lever;

a second turn pusher actuated by the rotary driving bit and connected to the second turn lever to rotate the second turn lever upon actuation by the driving bit to move the latch bolt to an unlocked position;

a mechanism that moves the second turn pusher in the path of the rotary driving bit when the dead bolt is moved from the projecting to the retracted position; and a mechanism for locking the handle shaft, which locking mechanism is arranged to be brought in a locked state wherein the handle shaft is locked in the first angular position and in an unlocked state wherein the handle shaft is unlocked, the locking mechanism comprising:

a locking device which is movable, in the first angular position of the handle shaft, between a first position that locks the handle shaft in the first angular position and a second position wherein the handle shaft is unlocked; and an actuator comprising an electromagnet that moves the locking device between the first and second positions, the electromagnet being arranged to move the locking device by magnetic attraction of at least a portion of the locking device, which portion of the locking device is movable in a direction forming an angle ($\alpha$) greater than about 45° with a flat plane ($\delta$) extending at right angles to the longitudinal axis of the handle shaft.

25. A lock comprising:

a frame;

a bolt movably mounted on the frame between a locked and an unlocked position and arranged to be operated by at least one handle;

a shaft for the handle, which shaft has a longitudinal axis and is pivotally mounted about the longitudinal axis on the frame between a first and a second angular position;

a mechanism for actuating the bolt upon rotation of the handle shaft to move the bolt from the locked to the unlocked position when the handle shaft is rotated from the first angular position to the second angular position and to move the bolt from the unlocked to the locked position when the handle shaft is rotated from the second angular position to the first angular position; and a mechanism for locking the handle shaft, which locking mechanism is arranged to be brought in a locked state wherein the handle shaft is locked in the first angular position and in an unlocked state wherein the handle shaft is unlocked, the locking mechanism comprising:

a locking device which is movable, in the first angular position of the handle shaft, between a first position that locks the handle shaft in the first angular position and a second position wherein the handle shaft is unlocked; and an actuator comprising an electromagnet that moves the locking device between the first and second positions, the electromagnet comprising a coil and a fixed core which is substantially not movable in the coil and being arranged to move the locking device by magnetic attraction of at least a portion of the locking device, which portion of the locking device is movable in a direction forming an angle ($\alpha$) greater than about 45° with a flat plane ($\delta$) extending at right angles to the longitudinal axis of the handle shaft.

26. The lock as claimed in claim 25, wherein the portion of the locking device arranged to be attracted magnetically has a shorter path of movement when locking and unlocking the handle shaft than a further portion of the locking device that locks the handle shaft.

* * * * *